US009615641B2

(12) United States Patent
Yeung et al.

(10) Patent No.: US 9,615,641 B2
(45) Date of Patent: Apr. 11, 2017

(54) SECURITY PROTECTED CREDIT CARDS CONTAINER AND BILLFOLD

(71) Applicants: Eric Tsz Kin Yeung, Concord (CA); Jackie Chi Ki Yeung, Concord (CA)

(72) Inventors: Eric Tsz Kin Yeung, Concord (CA); Jackie Chi Ki Yeung, Concord (CA)

( * ) Notice: Subject to any disclaimer, the term of this patent is extended or adjusted under 35 U.S.C. 154(b) by 259 days.

(21) Appl. No.: 14/544,959

(22) Filed: Mar. 10, 2015

(65) Prior Publication Data

US 2015/0216278 A1 Aug. 6, 2015

Related U.S. Application Data

(63) Continuation-in-part of application No. 13/573,822, filed on Oct. 9, 2012, now abandoned.

(51) Int. Cl.

| | |
|---|---|
| ***A45C 11/18*** | (2006.01) |
| ***A45C 1/06*** | (2006.01) |
| ***A45C 13/00*** | (2006.01) |
| *A45C 1/08* | (2006.01) |

(52) U.S. Cl.

CPC ..... *A45C 11/182* (2013.01); *A45C 13/007* (2013.01); *A45C 2001/065* (2013.01); *A45C 2001/067* (2013.01); *A45C 2001/083* (2013.01); *A45C 2011/186* (2013.01)

(58) Field of Classification Search

CPC ..... A45C 11/182; A45C 2001/065; A45C 2001/067; A45C 13/007; A45C 2001/083; A45C 2011/186

See application file for complete search history.

(56) References Cited

U.S. PATENT DOCUMENTS

| | | | | |
|---|---|---|---|---|
| 2,218,665 | A * | 10/1940 | Tamoschat | A24F 15/12 150/119 |
| 2,218,666 | A * | 10/1940 | Tamoschat | A24F 15/12 150/119 |
| 2,527,339 | A * | 10/1950 | Tamoschat | A24F 15/12 150/119 |
| 2,536,785 | A * | 1/1951 | Tamoschat | A45C 5/00 150/119 |
| 5,288,942 | A * | 2/1994 | Godfrey | A45C 11/182 150/147 |
| 6,026,873 | A * | 2/2000 | Van Geer | A45C 11/182 150/147 |
| 7,331,366 | B1 * | 2/2008 | Patterson | A45C 1/06 150/147 |
| 7,380,655 | B1 * | 6/2008 | Thune | A45C 1/06 206/214 |

(Continued)

*Primary Examiner* — Tri Mai

(74) *Attorney, Agent, or Firm* — David W. Wong

(57) ABSTRACT

A container and billfold for carrying credit cards and the like is provided with security protection for shielding surreptitious remote retrieval of the information stored in magnetic means on the cards. The upper edge portions of the cards are exposed in a staggered manner in the container for ready identification, selection and removal of a particular card during use. The container has a spring-loaded cam operated compression spring hinge to maintain it in either a closed condition in a snap action or in a secure opened condition with its upper housing pivoted to a maximum opening position of generally 49 degrees relative to the plane of the lower housing. A paper currency clip is also provided in the container.

10 Claims, 15 Drawing Sheets

(56) References Cited

U.S. PATENT DOCUMENTS

| | | | | |
|---|---|---|---|---|
| 7,918,335 | B1 * | 4/2011 | Kitchen | A45C 11/18 150/132 |
| 2006/0032021 | A1 * | 2/2006 | Fukuo | E05D 7/1011 16/298 |
| 2007/0215254 | A1 * | 9/2007 | Birke | A45C 1/06 150/138 |
| 2008/0190526 | A1 * | 8/2008 | O'Shea | G06K 19/07327 150/147 |
| 2008/0190784 | A1 * | 8/2008 | Phillips | A45C 11/182 206/39 |

* cited by examiner

SECURITY PROTECTED CREDIT CARDS CONTAINER AND BILLFOLD

This application is a continuation-in-part application of U.S. patent application Ser. No. 13/573,822 filed on Oct. 9, 2012 by the same applicants of this application.

FIELD OF THE INVENTION

This invention relates to a security protected billfold container for credit cards, debit cards, identity cards and the like and paper currency. More particularly, it relates to a wallet size billfold having protection against surreptitious remote retrieval of the information stored on the cards with electromagnetic scanning device such as RFID (Radio Frequency Identification Device) and similar electronic means.

BACKGROUND OF THE INVENTION

Credit cards, smart cards, and debit cards which are commonly referred to as charge cards for payment of commercial transactions, and personal identity cards, are provided with magnetic means such as a magnet strip or a magnetic chip for storing on the cards the details of account and/or personal information of the card owner. The information is retrieved during use by scanning or inserting the card into a card reader for payment of a variety of services or for identification purposes. The information recorded on the card may however also be accessed remotely with an RFID or similar electronic means located in the close vicinity or proximity of the card. Since the cards are always carried by the owner in the owner's wallet or purse, it is invariably freely exposed to illegal or surreptitious access of the information by some one carrying a portable RFID or similar electronic scanning device by positioning the scanning device near or in close proximity of the card owner to retrieve the information from the cards for illegal purposes such as recreating duplicate cards for illegal uses or payments. Many methods have been employed to prevent such illegal remote surreptitious retrieval of the card information. Since RFID signals can not penetrate through a shielding plate such as a metal plate or alloy plate, one method is to locate one or two shielding plates on the outer or both sides of the outermost part of the container of the cards in a wallet or purse. The shielding plate or plates would block the RFID signal from reaching the cards to access the information. However, the inclusion of shielding plates invariably renders the card container rather bulky or the physical access of the cards during use by the owner difficult.

Moreover, charge cards and identity cards are commonly contained in pockets or plastic sleeve envelopes provided in a wallet. In the case of plastic sleeve envelopes, they are clear plastic sleeve envelopes bound in a bundle or a stack manner in the wallet. One or more cards may be inserted into each sleeve envelope. In use, a required card can be removed from the particular sleeve envelope containing it. As the sleeve envelope are of the same size of the card, it is awkward and frustrating to remove the card out of the sleeve envelope or to insert it into the sleeve envelope, particularly when two or more cards are necessarily contained in each single sleeve envelope for accommodating a plurality of cards. Same problems exist when the cards are stored in pockets provided on the side panels in the wallet or inside the wallet.

Furthermore, due to the stacking or bundling of the sleeve envelopes, particularly when two or more cards are contained in each sleeve envelope or pocket, some of the cards in the stack are not readily visible since they would be sandwiched or covered completely by other cards positioned in front, behind, or on top so that often it is difficult to locate a particular card from the stack or bundle.

Hard plastic cases have also been employed for carrying the cards in a stacked manner. The cards must all be removed simultaneously from such a hard case for selecting a particular card required during use and that the simultaneous removal of all the cards are susceptible to accidental misplacement and loss of the removed cards. Moreover, most such plastic cases are provided with a cover which is held in the closed position with a latch, or the case consists of two half cases held together with a latch. Such cases are difficult or unwieldy to operate and requiring the user to operate it with both hands.

SUMMARY OF THE INVENTION

It is a principal object of the present invention to provide a billfold container for carrying and protecting the charge and identity cards contained therein from surreptitious access of the card information with a remote RFID or similar device.

It is another object of the present invention to provide a billfold container in which the cards can be easily placed therein or removed therefrom.

It is yet another object of the present invention to provide a billfold container in which all the cards stored therein are readily identifiable for selection of any card during use.

It is still another object of the present invention to provide a billfold container for carrying charge and identity cards which is convenience to operate and can be operated with one hand.

It is still yet another object of the present invention to provide a billfold container including a spring clip for carrying paper currency therein.

It is yet another object of the present invention to provide a billfold container which has a compression spring hinge for maintaining its upper and lower housings in secured opened or closed conditions.

BRIEF DESCRIPTION OF THE DRAWINGS

Other objects of this invention will appear in the following description and appended claims reference being made to the accompanying drawings forming a part of the specification wherein like reference numerals designate corresponding parts in the several views.

DETAILED DESCRIPTION OF THE PREFERRED EMBODIMENTS

With reference to the drawings, the billfold container 10 of the present invention consists of a top housing 11 and a lower housing 12 mounted together with a hinge 13 so that the container can be opened and closed easily during use. The billfold container 10 may be made of a plastic material, metal or similar material, and may have convenient overall dimensions of 7.5 cm by 11 cm by 1 cm similar to a common small wallet.

Figure 6:
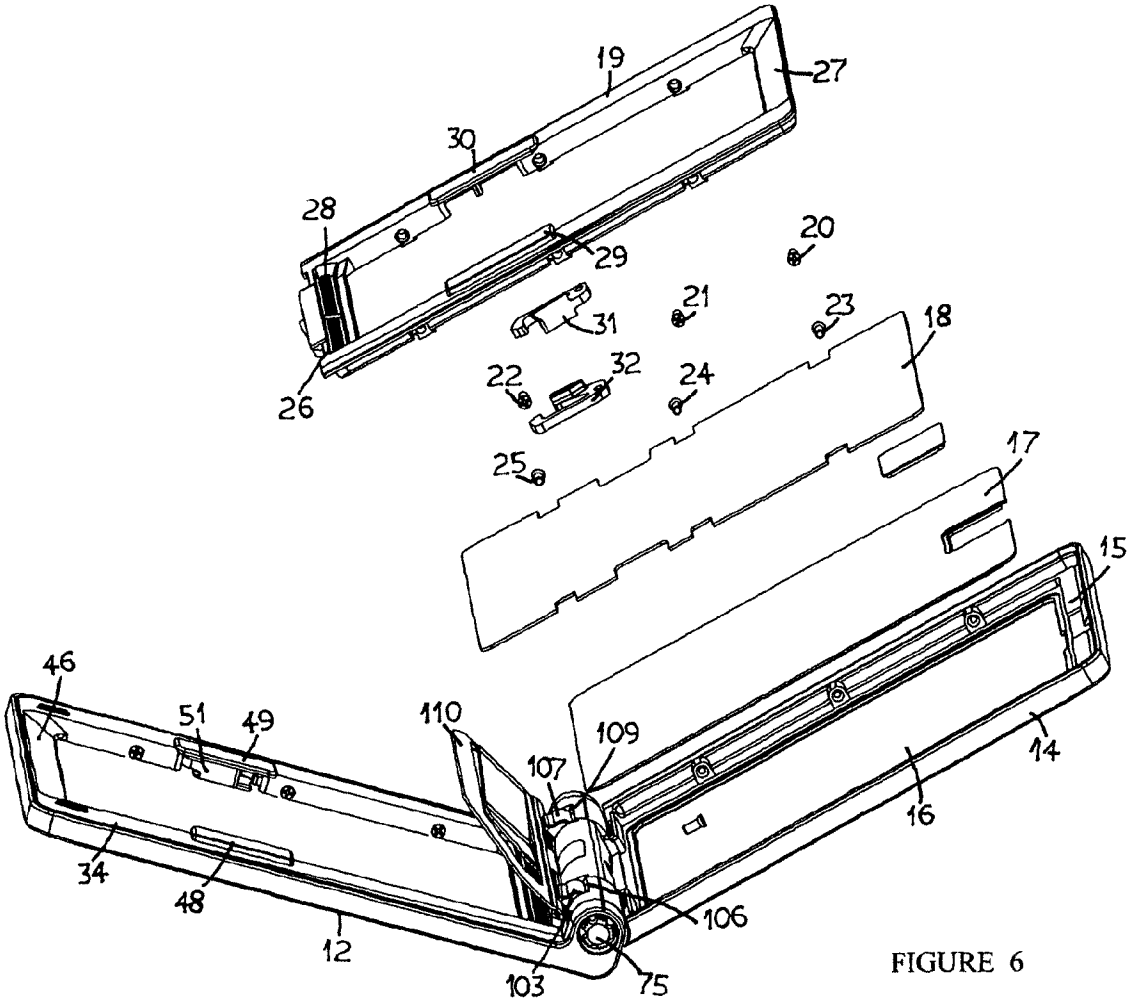
FIG. 6 is an top and side perspective view showing the components of the top housing of the billfold container in an exploded view of the components in the top housing.

As best shown in FIGS. 6, the top housing 11 has a rectangular main frame 14 with an inner rectangular surrounding rim 15 formed on an inner surface of the main frame 14. The inner edges of the inner rectangular surrounding rim 15 defines a rectangular outer frame opening 16 of the top housing 11. A top enclosure panel 17 is located in the rectangular frame 14 with its edge portions abutting the rectangular shoulder 15 and enclosing the rectangular outer frame opening 16 to form the enclosure top panel of the top housing 11. A shielding plate 18 made of a material such as metal, metal alloy, or plastic impregnated with metal, having the property of shielding RFID or similar electronic transmission signals, is located on the top enclosure panel 17. A top mounting frame 19 having outer dimensions equal to the inner dimensions of the inner dimensions of the top housing 11, is located and secured to the inside of the top housing 11 for mounting the top enclosure panel 17 and the top shielding plate 18 securely in the top housing 11 such as by screws 20, 21, 22, 23, 24 and 25 to the inner side wall of the main frame 14 of the top housing 11. The top mounting frame 19 preferably has an inner width of 5.3 cm which is equal to the width of a conventional charge card, a height of about 8.5 cm, and a depth of about 0.3 cm such that a stack of a plurality of charge cards may be placed inside the top mounting frame 19 as best shown in FIG. 6.

Figure 7:
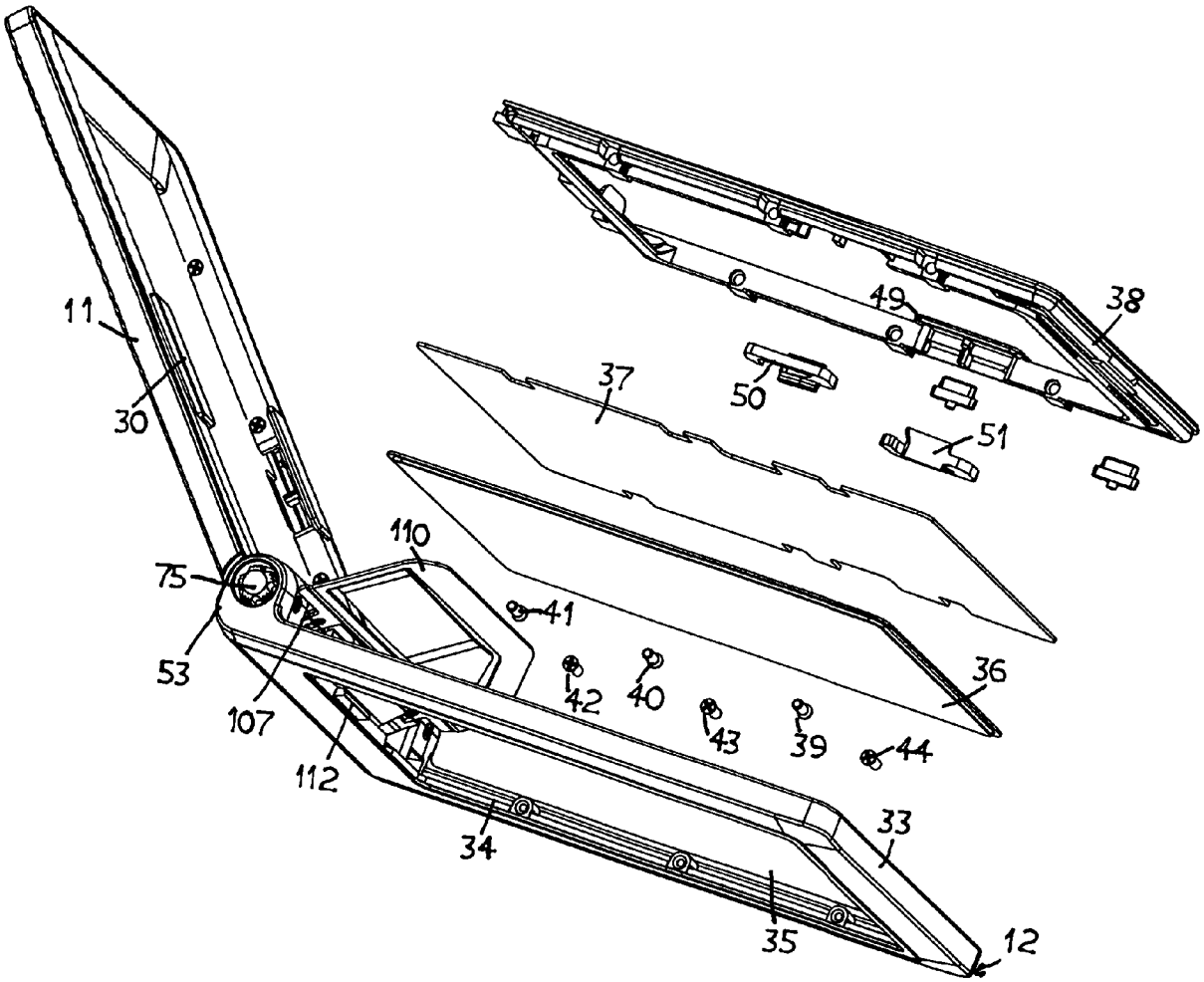
FIG. 7 is a bottom and side perspective view showing the components in the lower housing thereof in an exploded view.

The lower inner side wall 26 of the top mounting frame 19 slopes downwardly and outwardly from the shielding plate 18 towards the inner rim surface of the top mounting frame 19 as best shown in FIG. 7. Also, the upper inner side wall 27 of the top mounting frame 19 preferably slopes upwardly and outwardly from the shielding plate 18 towards the inner rim surface of the top mounting frame 19. A plurality of transverse steps 28 are formed on the sloping lower inner side wall 26.

Two retaining arms 29 and 30 having a transverse L shape are provided on opposite sides and are located about the middle portion of the inner rim of the top mounting frame 19. The retaining arms 29 and 30 have an inner free edge extending in an overhanging manner towards one another so that charge cards may be inserted into the top mounting frame 19 under the retaining arms 29 and 30 in a stack manner. When the lower edges of the charge cards inserted into the top mounting frame 19 would invariably abut separate transverse steps 28 in the downwardly sloping inner side wall 26 so that the top edge portions of the charge cards in the stack would also invariably be exposed in a staggered manner to provide ready identification of the cards in the stack to facilitate easy selection of a particular charge card in the stack. The sloping upper inner side wall 27 of the top mounting frame 19 also facilitates the card stack in the top mounting frame 19 to be pushed forward in order that a selected charge card may be removed easily from the stack.

Two torsion springs 31 and 32, which may have a generally C shape, are mounted on the opposite inner side walls of the top mounting frame 19 and preferably located beneath the two retaining arms 29 and 30 respectively. The springs 31 and 32 press against the opposite sides of the stack of charge cards in the top mounting frame 19 to maintain the stack securely and neatly in place.

The lower housing 12 has similar construction as the top housing 11. As best shown in FIG. 7, it consists of a rectangular main frame 33 having a surrounding inner rim 34 formed on the outer side of the lower housing 12. The inner edges of the inner rectangular surrounding rim 34 defines a rectangular bottom frame opening 35 of the lower housing 12. A lower enclosure panel 36 is located in the rectangular frame 33 with its outer edge portions abutting the rectangular rim 34 and enclosing the rectangular bottom frame opening 35 to form the enclosure bottom panel of the lower housing 12. A shielding plate 37 having the property of shielding electronic scanning waves such as RFID is located on top of the lower enclosure panel 36. A lower mounting frame 38 having outer dimensions equal to the inner dimensions of the lower housing 12, is located and secured to the lower housing 12 for mounting the lower enclosure panel 36 and the shielding plate 37 in the lower housing 12. Screws 39, 40, 41, 42, 43 and 44 may be employed for securing the lower mounting frame 38 to the rectangular frame 33 of the lower housing 12. The opening of the lower mounting frame 38 also preferably has an inner width of 5.3 cm which is equal to the width of the conventional charge card, a height of about 8.5 cm, and a depth of about 0.3 cm such that a stack of a plurality of charge cards may be placed inside the opening of the lower mounting frame 33 as best shown in FIGS. 6 and 7. The lower inner side wall 45 of the lower mounting frame 33 slopes outwards and upwards from the shielding plate 37 and the inner upper inner side wall 46 also slopes outwards and upwards from the shielding plate 37, and a plurality of transverse steps 47 are formed on the inner lower side wall. Therefore the lower edges of cards placed in the lower mounting frame 38 will abut separate transverse steps 47 in the lower inner side wall 45 such that an upper edge portion of the cards will be exposed to facilitate identification, selection and removal of a particular card during use. The sloping upper inner wall 46 also facilitates the easy removal of the card.

Two retaining arms 48 and 49, preferably having a cross sectional L-shaped, are provided on the surface of the surrounding inner rim 34 of the opposite sides of the lower mounting frame 38 and are located preferably just below the middle portion of the sides of the lower mounting frame 38. The retaining arms 48 and 49 have an inner free edge portion extending in an overhanging manner over the opening of the lower mounting frame 38 for retaining the stack of charge cards securely located within the lower mounting frame 38.

Two torsion springs 50 and 51, which may have a C shape as shown, are mounted on the opposite side walls of the lower mounting frame 38 and preferably located beneath the retaining arms 48 and 49. The torsion springs 50 and 51 will press against the opposite sides of the stack of charge cards in the lower mounting frame 33 to maintain the stack of charge cards in a secure and neat manner within the lower mounting frame 33.

Figure 5:
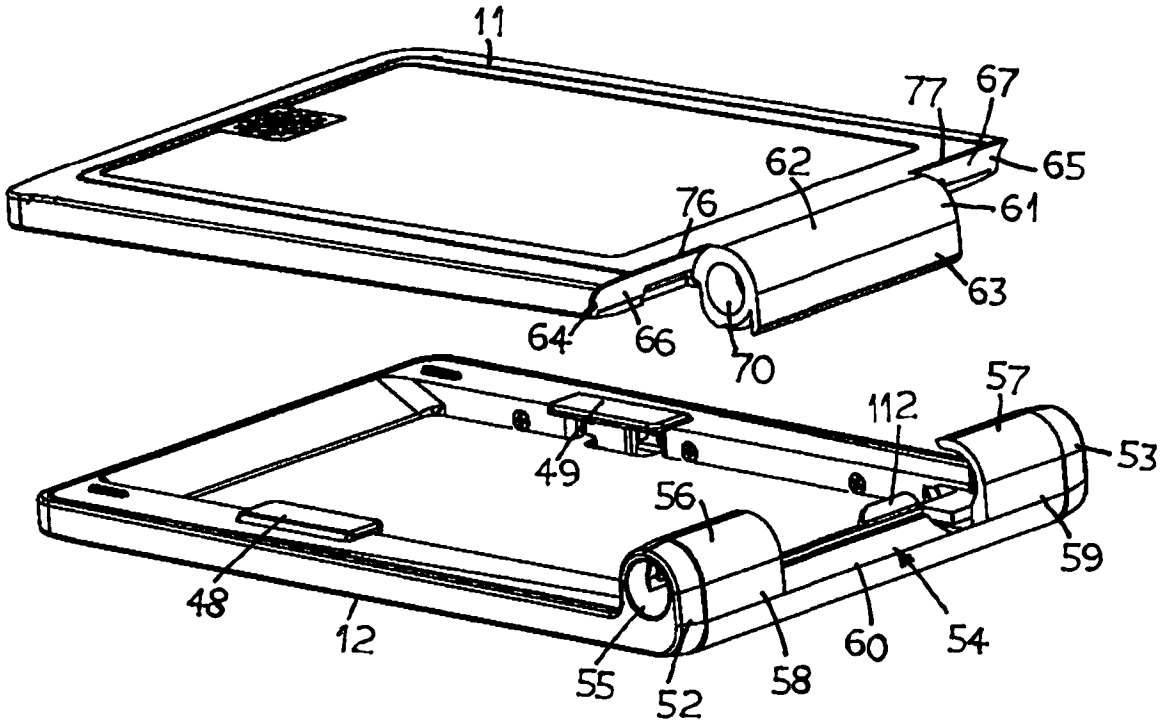
FIG. 5 is a top and rear exploded view of the top and lower housings of the billfold container.
Figure 12:
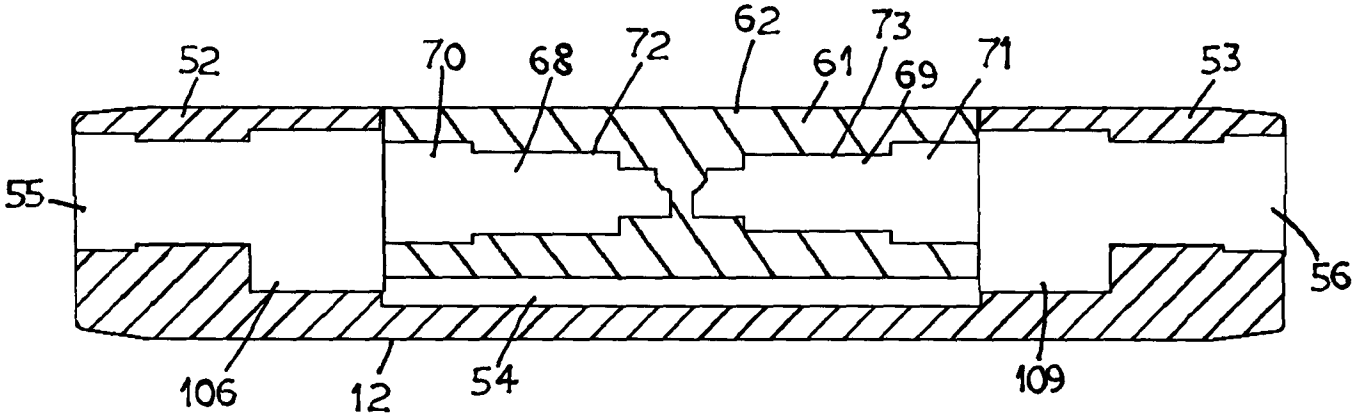
FIG. 12 is a rear cross section view of the hinge portion of the billfold container showing the through openings formed in the hinge sleeve portions of the power housing and the closed end openings formed in the two sides of the central hinge sleeve portion of the upper housing.
Figure 13:
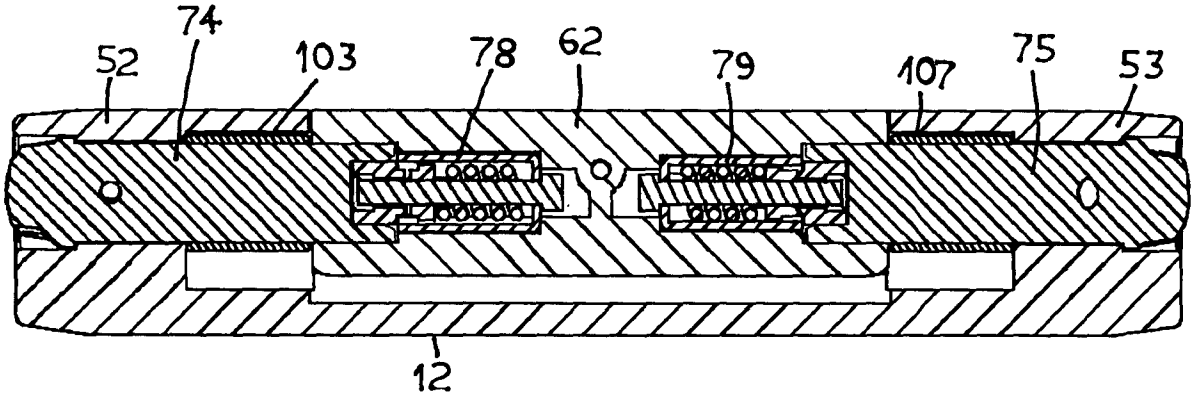
FIG. 13 is a cross section view of the hinge portion with the compression spring units mounted in the central hinge sleeve of the upper housing and the pivot pins fixedly mounted in the hinge sleeve portions of the lower housing.
Figure 15:
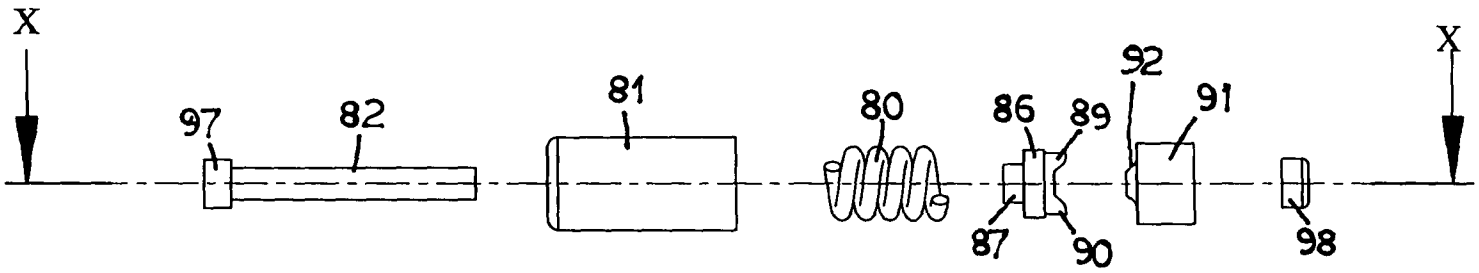
FIG. 15 is a side exploded view view of the compression spring unit

As shown in FIGS. 5,12, and 13 the hinge construction of the billfold container 10 consists of two upstanding hinge sleeve portions 52 and 53 formed at the two rear end portions of the lower housing 12. The hinge sleeve portions 52 and 53 are spaced from one another by a space 54. A through axial opening 55 is formed in the hinge sleeve portion 52 and a similar through axial opening 56 is formed in the hinge sleeve portion 53. The through openings 55 and 56 are axially aligned with one another. The hinge sleeve portions 52 and 53 have round upper surfaces 56 and 57 respectively which slope rearwardly to vertical rear walls 58 and 59 respectively. The space 54 between the hinge sleeve portions 52 and 53 has a curve bottom surface 60 having a curvature same as the curvature of the upper surfaces 56 and 57 of the hinge sleeves 52 and 53. A downwardly extending central hinge sleeve portion 61 is formed at the central rear portion of the upper housing 11. The central hinge sleeve portion 61 is similar in cross sectional size and shape to the hinge sleeve portions 52 and 53 of the lower housing 12, and has an upper surface 62 sloping rearwardly to a vertical surface 63 similar to that of the hinge sleeve portions 52 and 53. The length of the central hinge sleeve portion 61 is equal to the space 54 located between the hinge sleeve portions 52 and 53. Two recessed end portions 64 and 65 are formed at the two rear ends of the upper housing 11. The wall of the recessed end portions 64 and 65 have a curvature 66 and 67 equal to the upper surfaces 56 and 57 of the hinge sleeve portions 52 and 53 respectively and they are equal in length to the latter respectively also. Closed end axial openings 68 and 69 are formed in the two ends of the central hinge sleeve portion 61. As best shown in FIG. 15, the outer portions 70 and 71 of the axial openings 68 and 69 have a diameter equal to the through axial openings 55 and 56 respectively. The closed end inner axial openings 72 and 73 have two flat opposite side walls and a cross sectional width smaller than that of the diameter of the outer portions 70 and 71 of the hinge sleeves 52 and 53 respectively.

The upper housing 11 and lower housing 12 are hingedly mounted together by engaging the central hinge sleeve portion 61 with the space 54 between the hinge sleeve portions 52 and 53 such that the axial through openings 55 and 56 are aligned with the closed end axial openings 68 and 69 respectively and hinge pins 74 and 75 are inserted from the two outer ends of the through axial openings 55 and 56 respectively and extending into the outer end portions 70 and 71 of the central hinge portion 61 of the upper housing 11. The upper housing 11 can be pivotally operative relative to the lower housing 12 to a closed position to lie juxtaposed on top of the lower housing 12 and alternatively to an opened position at an obtuse angle to lie about 49 degree relative to the plane of the lower housing 12 as best shown in FIGS. 8, 9, 10 and 11. The upper edges 76 and 77 of the curved recessed end portions 64 and 65 will abut the vertical surfaces 58 and 59 of the hinge sleeve portions 52 and 53 respectively to maintain the two housings in such preferred opened position.

Figure 14:
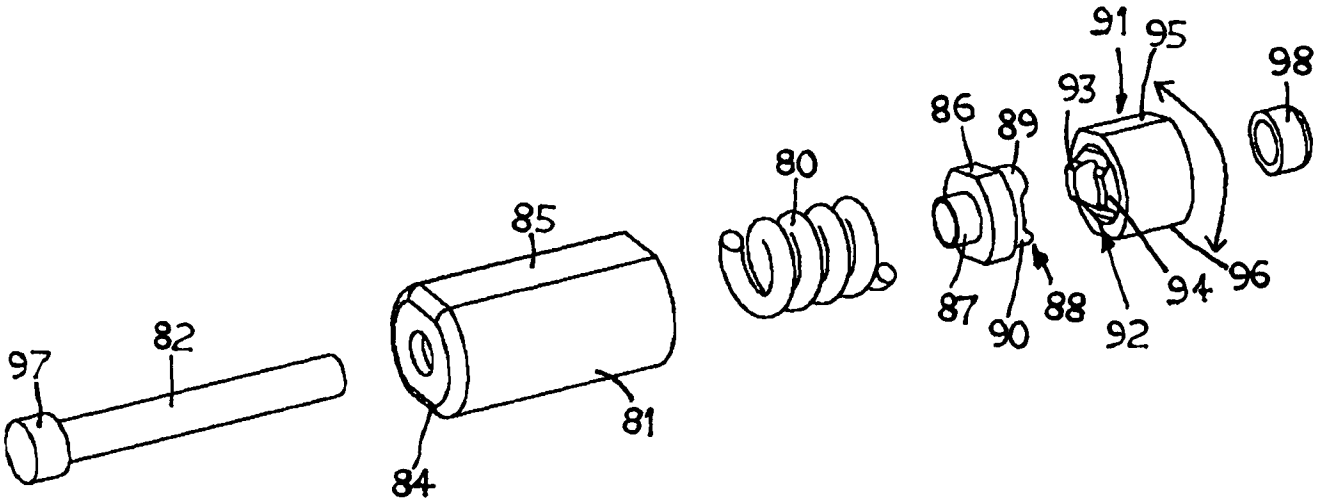
FIG. 14 is a perpective exploded side view of the torsion spring unit showing the components thereof.
Figure 16:
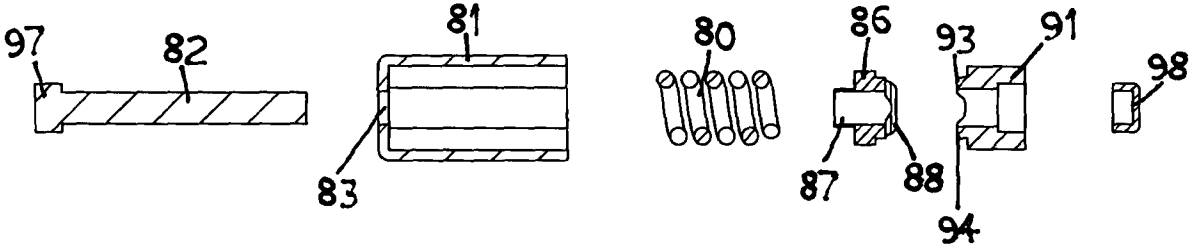
FIG. 16 is a side cross section view of the compression spring unit along the cross section line X-X in FIG. 15.

A compression spring unit 78 is fixedly mounted in the closed end inner axial opening 72 and a similar compression spring unit 79 is fixedly mounted in the closed inner axial opening 73 of the central hinge sleeve portion 61. The width of the torsion spring units 78 and 79 between two outer flat side walls of its casing is equal to the width between the two flat side walls of the inner axial openings 72 and 73 respectively so that the compression spring units 78 and 79 are retained in the mounted position within the central hinge sleeve portion 61. Therefore, the upper housing is pivoted relative to the lower housing, the compression spring units 78 and 79 will be rotated with the central hinge sleeve 61 accordingly. As best shown in FIGS. 14, 15 and 16, the torsional spring units 78 and 79 are similar in construction which comprises of a coil spring 80 located in a closed end casing 81. A mounting pin 82 is inserted through a central opening 83 formed at the closed end of the casing 81. The casing 81 has two diametrically opposite flat outer side walls 84 and 85 which engage with the opposite flat inner side walls of the inner axial openings 72 and 73 to maintain the compression spring units 78 and 79 fixedly mounted within the central hinge sleeve portion 61 of the upper housing 11. An end slider 86 is located at the end portion of the opened end of the casing 81 and it body has two opposite flat side walls such that its cross section shape is similar to the cross sectional shape of the casing 81 with its cross sectional dimensions slightly smaller than the cross sectional diametrical dimensions of the casing 81. The end slider 86 is slidably mounted on the mounting pin 82 such that it is slidable along the mounting pin 82 in the axial direction of the casing 81. The two opposite flat side walls of the end slider are slidably engage with the two flat side walls 84 and 85 of the casing 81 so that rotation of the casing 81 of the end sliders due to the pivoting movement of the top housing relative to the lower housing of the container would also cause the end slider 86 to rotate accordingly. A short cylindrical boss 87 is located on an inner surface of the end slider. The cylindrical boss 87 engages with the central opening of the coil spring 80 and the end of the coil spring 80 abuts the inner surface of the end slider 86 so that the end slider is securely engaged with the end portion of the coil spring 80. A U-shaped cam 88 is located at the outer surface facing outwards from the casing 81 of the end slider 86. The cam 88 has two diametrically opposite cam arms 89 and 90 extending outwards from its outer surface. The cam arms 89 and 90 have sloping cam edges. A guiding cam 91 is mounted on the end of the mounting pin 82 adjacent to the opened end of the casing 81. The guiding cam 91 also has a U-shaped cam arm 92 having a complementary shape of that of the U-shaped cam 88 of the end slider 86 and having diametrically positioned cam arms 93 and 94 with sloping cam edges. Rotation of the torsion spring unit by pivoting the upper housing and, in turn, the rotation of the end slider 86 will cause the cam 88 of the end slider 86 to rotate relative to the cam arm 92 of the guiding cam 91 with the latter held in a fixed position by the hinge pin 74 which is mounted fixedly to the hinge sleeves of the lower housing of the container 10. Thus the rotation of the upper housing 11 will cause the two cams 88 and 92 to engage in a first position with the cam arms 89 and 90 of the end slider 86 sliding to engage with the depression between the cam arms 93 and 94 of the guiding cam 91, and in another position with the cam arms 89 and 90 of end slider 86 abutting the outer end surface of the outwardly extending cam arms 93 and 94 of the guiding cam 91 to urge the end sliders to move slidably inward into the casing 81 against the spring force of the coil spring 80. The cam 88 is in the first position when the upper housing 11 and the lower housing 12 are in the closed condition with the upper housing lying juxtaposed on top of the lower housing, and the tip of the cam 88 of the end slider 86 are rotated to engage the tip of the cam arms of the guiding cam 91 when the upper housing 11 is pivoted to the opened position lying at the preferred obtuse angle from the lower housing 12. The cam arms of the end sliders 86 engage with the depression of the cam 88 of the guiding cam 91 in a snap action by the spring force of the coil spring 80 of the compression spring units 78 and 79, when the upper housing 11 is pivoted to lie juxtaposed on top of the lower housing, to maintain the billfold in a secured closed condition. A slot 99 is formed at the inner end of the hinge pin 74 and similarly a slot 100 is formed at the inner end of the hinge pin 75. The width of the slots 99 and 100 of the hinge pin 74 and 75 is equal to the width between the two flat outer sidewalls of the guiding cam, so that the two flat outer side walls of the guiding cams of the compression spring units 78 and 79 engage with the two flat sides of the hinge pins 74 and 75. The hinge pins 74 and 75 are mounted to the hinge sleeve portions 52 and 53 of the lower housing 12 with set screws 101 and 102 as best shown in FIGS. 7 toll so that pivoting the upper housing 11 to rotate the hinge spring units and, in turn, the end sliders, will cause the end sliders to rotate relative to the guiding cams with the latter being held stationary by the hinge pins 74 and 75. The compression spring units also maintain the upper and lower housings in a secured opened condition with the end slider being forced to slide inward into the casing against the spring force of the coil spring. The spring force will maintain the upper housing 11 securely positioned in the maximum opened condition.

Figure 1:
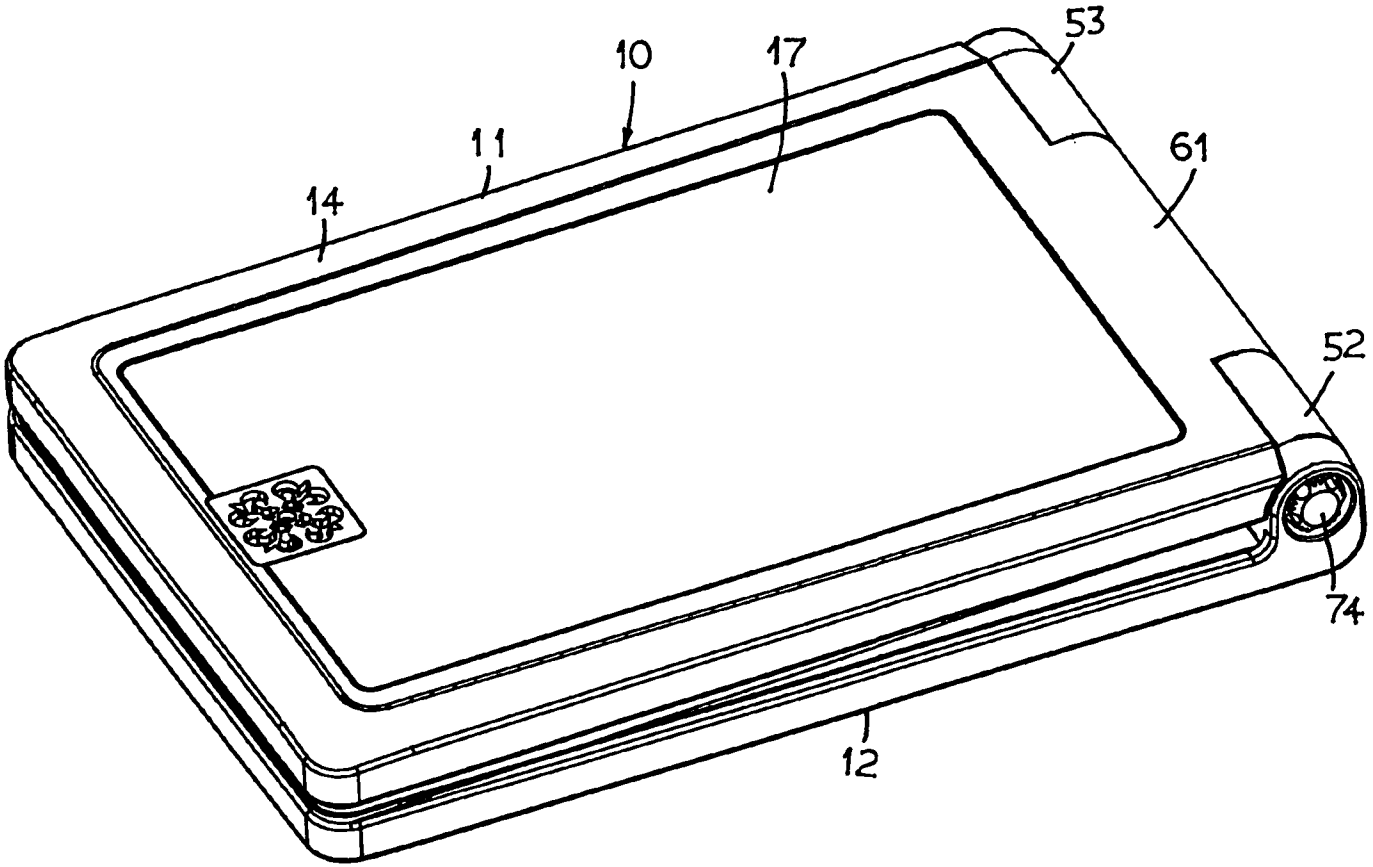
FIG. 1 is a front top and side perspective elevation view of the billfold container of the present invention in the closed condition.
Figure 2:
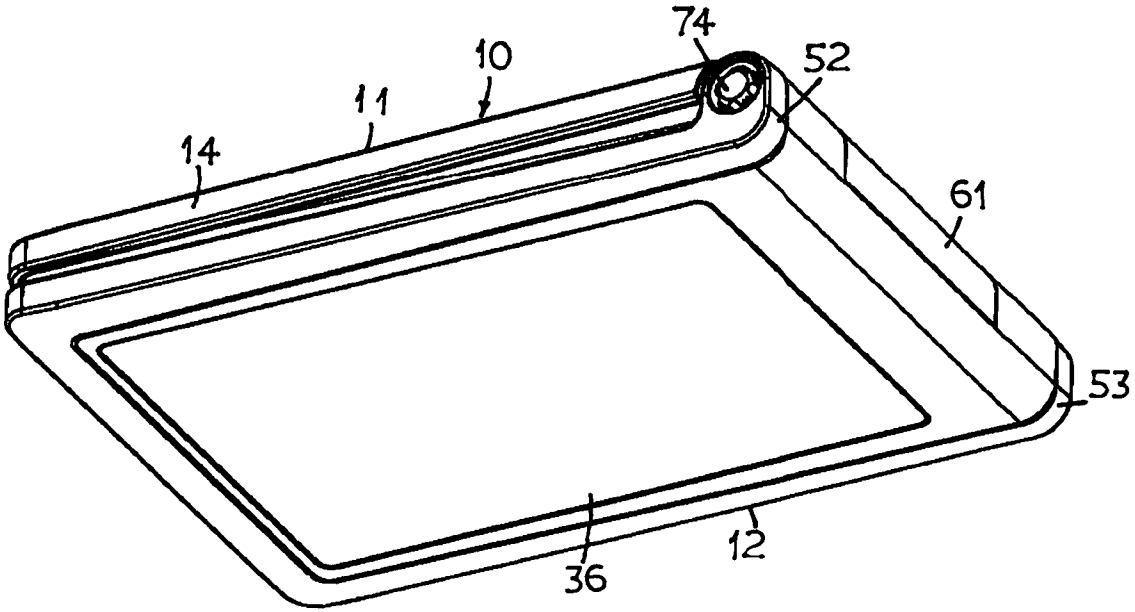
FIG. 2 is a back bottom and side perspective elevation view thereof.
Figure 3:
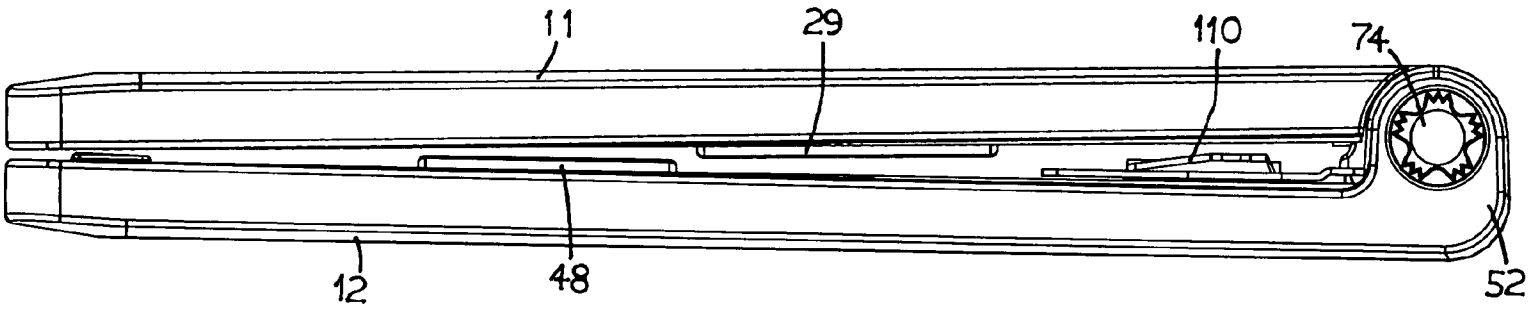
FIG. 3 is a side perspective elevation view thereof.
Figure 4:
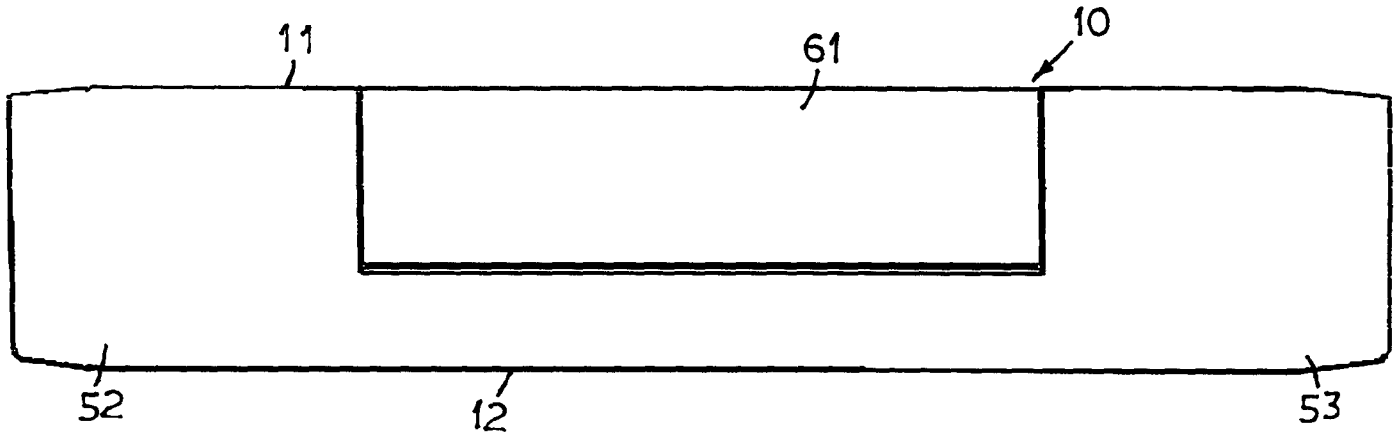
FIG. 4 is a rear perspective elevation view of the billfold container.
Figure 8:
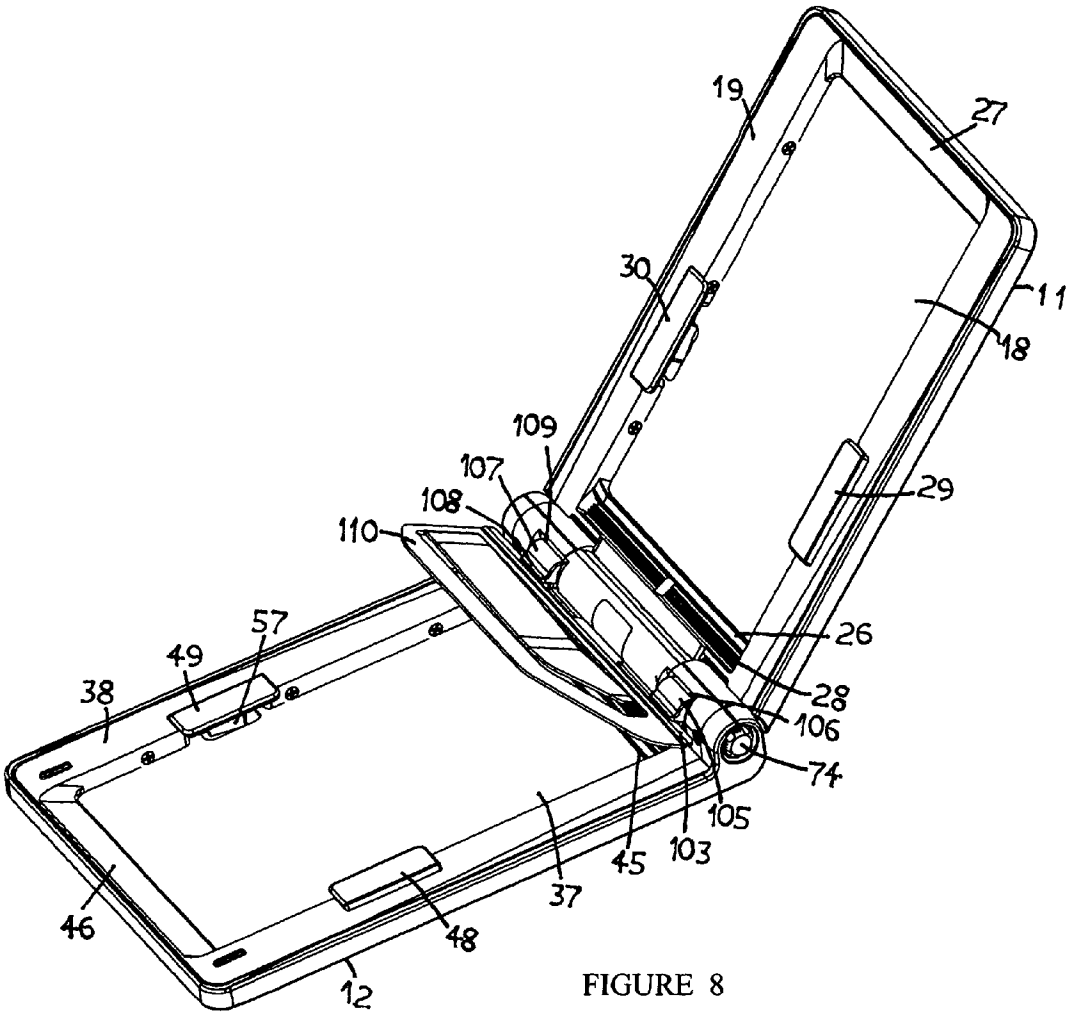
FIG. 8 is a top and side perspective view of the billfold container in the opened condition.
Figure 9:
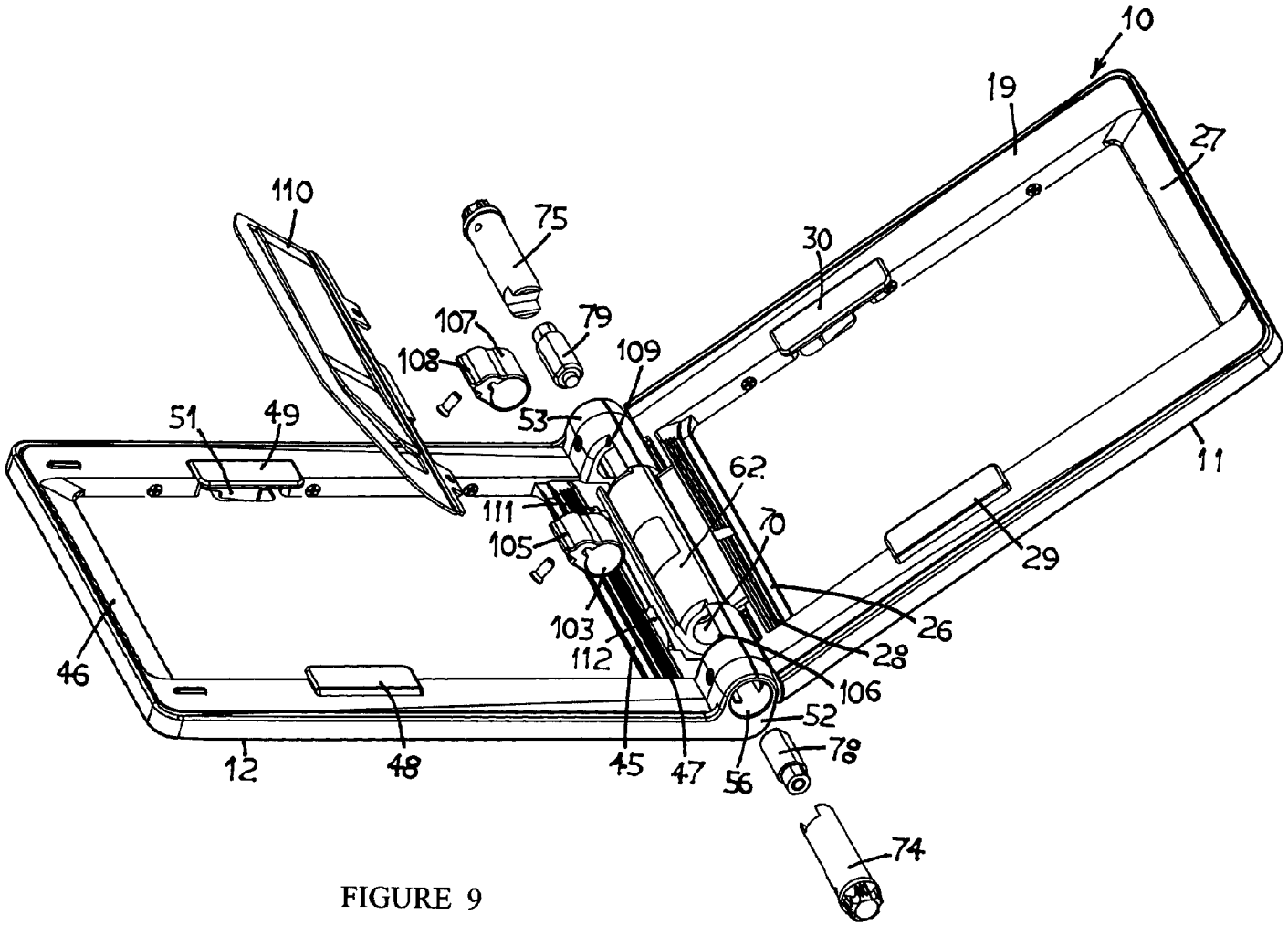
FIG. 9 is a top and side exploded view showing the components of the hinge and the money clip of the billfold container.
Figure 10:
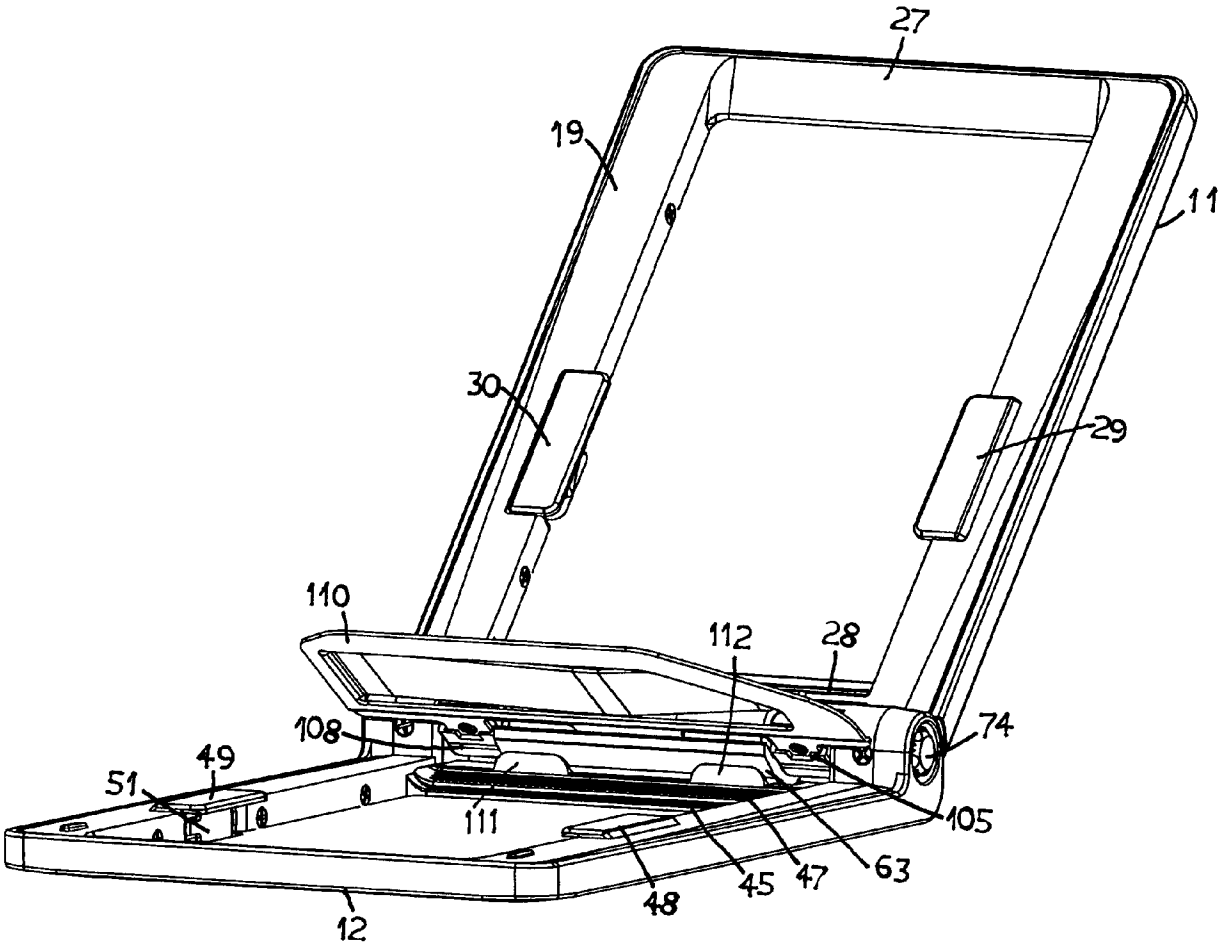
FIG. 10 is a front and side perspective view showing the position of the money clip supported by the lower edge of the central hinge sleeve portion of the upper housing when the billfold container is in the opened condition.
Figure 11:
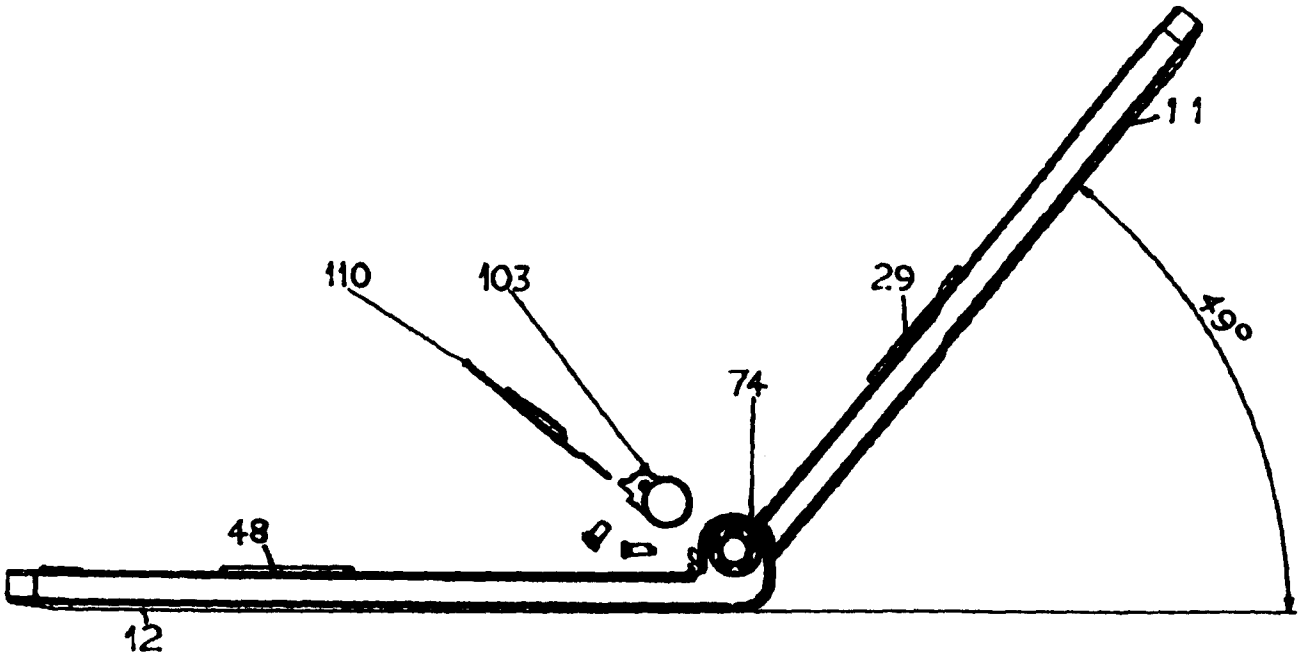
FIG. 11 is a side elevation view thereof in the maximum opened condition with the upper housing position at about 49 degrees from the plane of the lower housing and also showing the money clip its mounting ring in an exploded view.

A generally Q-shaped ring 103 having a ring-shaped portion 104 rotatably mounted on the hinge pin 74, and it has an extension arm 105 extending outwards from its bottom through a cut out 106 (see FIGS. 6, 8, 9 and 10) formed at the inside border sidewall of the hinge sleeve portion 52. A similar generally Q-shaped ring 107 is rotatably mounted on the hinge pin 75 and it has an extension arm 108 extending outwards from its bottom through a cut out 109 formed at the inside border sidewall of the hinge sleeve portion 53. A paper currency clip 110 is provided in the billfold container. The paper currency clip has a spring arm operative for clamping several paper currency thereon in a folded manner. The paper currency clip is mounted at its rear edge to the extension arms 105 and 107 of the Q-shaped rings 103 and 107 such as with screws shown as an exemplary embodiment. The currency clip 110 is thus pivotable relative to the hinge pins 74 and 75 by rotating the rings 103 and 107 relative to the hinge pins, and it normally rests on top of the lower housing 12 by gravity of its weight when the billfold container 10 is in the closed condition (see FIG. 3). When pivoting the upper housing 11 to the opened position, the lower edge of the central hinge sleeve 62 will abut the rear edge of the currency clip 110 to pivot the latter upward also. The currency clip 110 will rest on the lower edge of the central hinge sleeve 62 of the upper housing 11 at the tilt up position as best shown in FIGS. 8, 10 and 11 when the upper housing 11 is pivoted to the maximum opened position to facilitate easy access of the paper currency clip portion for either placing paper currency on the clip or removing the paper currency therefrom as well as sliding a selected charge card from the charge card stacks with the thumb of the hand holding the container 10. Thus, the billfold container 10 of the present invention can be conveniently held and operated to the opened or closed positions as well as sliding a selected charge card outwards from the charge card stacks with the thumb by using one hand only by the user. After a paper currency has been placed onto the money clip 110, the upper housing 11 may be pivoted towards the closed position so that the it will close in a snap action under the spring force of the compression spring units to fold the paper currency automatically within the billfold container and to hold the money currency in place within the billfold container securely.

The opened position of the upper housing orientated to about 49 degree relative to the plane of the lower housing would hide the view of the paper currency from a person located opposite to the user to provide security protection in using the billfold container. The upper housing is only required to be pivoted upwards to about 65 degrees from the lower housing and the spring force of the hinge will automatically open the container therefrom to the preferred obtuse angle opened condition under the spring force of the compression spring units, similarly, the billfold container can be pivoted from the opened condition to the close condition by only pivoting the upper housing downward to about 65 degree from the lower housing and the spring force of the compression spring units will automatically close the container therefrom in a snap action under the spring force of the compression spring units to the secure closed condition.

As best shown in FIGS. 5, 7, 9, and 10, abutment ridges 111 and 112 are provided on the lower inner side wall 45 of the lower mounting frame 33 immediately adjacent to the transverse steps 47 so as to prevent any charge card, particularly the charge card lying on top of the charge card stack, located in the lower housing 12 from sliding accidentally beyond the lower inner side wall 45 into the hinge to interfere with the hinge operation.

While the preferred embodiments of the invention have been described above. It will be recognized and understood that various modifications may be made therein and the appended claims are intended to cover all such modifications which may fall within the spirit and scope of the invention.

What is claimed is:

1. A security protected container and billfold for carrying credit cards and the like comprising:

a top housing and a lower housing hingedly mounted together to one another at a rear end, each of said top housing and said lower housing having an outer enclosure panel;

a rectangular main frame surrounding an outer rectangular frame opening, and an inner rectangular surrounding rim formed on an inner surface of said rectangular main frame, and inner edges of said inner rectangular surrounding rim defining a rectangular frame opening;

a shielding plate located within each of said top housing and said lower housing and being in abutment with and covering over entirely inner surface of said outer enclosure panel, a mounting frame located inside said rectangular main frame, and said shielding plate being positioned in place within said mounting frame;

said mounting frame and said shielding plate together forming a compartment for receiving said cards to be placed therein in a stacked manner;

two L-shaped retainers formed on an inner surface on two opposite vertical sides of said mounting frame, said retainers having a free edge portion extending in an overhang manner and extending inwardly of said mounting frame for retaining said cards securely located within said compartment;

said mounting frame having a lower side wall sloping downwardly and outwardly from said shielding plate, and an upper side wall sloping upwardly and outwardly from said shielding plate, a plurality of transverse steps formed on said lower side wall whereby lower edges of said cards placed and stacked in said mounting frame abut said steps on said sloping lower side wall of said mounting frame with the lower edge of each individual card engaging with a separate transverse step on the sloping lower side wall to render upper edge portions of said cards to expose in a staggered manner to facilitate ready identification, selection and removal of a selected card from the stack.

2. A security protected container and billfold according to claim 1 including a rectangular cover plate abutting said inner rim and enclosing said rectangular frame opening to form said enclosure panel of said rectangular main frame; and said mounting frame being secured to said rectangular main frame for retaining said shielding plate and said rectangular cover plate securely mounted in place within said compartment.

3. A security protected container and billfold according to claim 2 including two torsion springs mounted on two vertical opposite side walls of said mounting frame of each of said top housing and said lower housing and located below said free edge portion of said retainers; said torsion springs being operative for abutting opposite side edges said cards to maintain said cards in a stack securely and safely in place in said compartment.

4. A security protected container and billfold according to claim 3 wherein said top housing and said lower housing are mounted together with hinge pins and associated compression spring hinge units operative to maintain said top housing and said lower housing to positioned juxtaposed to one another in a closed condition in a snap action and to positioned in an obtuse angle in an opened condition with the upper housing extending at a generally 49 degrees relative to the plane of the lower housing.

5. A security protected container and billfold according to claim 4 including a currency clip mounted to said hinge and operative for carrying a selected amount of paper currency in said container and billfold.

6. A security protected container and billfold according to claim 5 wherein said shielding plate is made of an electromagnet waves blocking material selected from the group consisting of: metal, and metal alloy.

7. A security protected container and billfold according to claim 4 including a central hinge sleeve portion formed at a rear end of said top housing, closed end axial openings formed in two ends of said central hinge sleeve portion; two upstanding hinge sleeve portions formed at two end portions of a rear end of said lower housing; said upstanding hinge sleeve portions being spaced from one another by a mounting space, and both of said upstanding hinge sleeve portions having an axial through opening formed therein; said hinge sleeve portions having a curved top wall curving to a vertical rear outer wall, said central hinge sleeve portion of said upper housing having a vertical rear wall, two rear edge recessed portions of said upper housing located on two sides of said central hinge portion, said two rear edge recessed portions having a lower edge, and said top housing and said lower housing being mounted together with said central hinge portion of said top housing engaged with said space between said upstanding hinge sleeve portions of said lower housing; said hinge pins being fixedly mounted in said axial through openings of said upstanding hinge sleeve portions of said lower housing, and an inner end of said hinge pins engaged with compression spring hinge units mounted in said closed end axial openings of said upper housing, said lower edge of said two rear edge recessed portions abutting said vertical rear outer wall of said upstanding hinge sleeves of said lower housing when said upper housing is pivoted to said opened condition.

8. A security protected container and billfold according to claim 7 wherein said compression spring hinge units include cam means provided thereon, each one of said compression hinge units having a casing with two opposite flat outer side walls engaging with two opposite flat side walls of said closed end axial openings in said central hinge portion of said top housing, said cam means being operative when said upper housing is pivoted for positioning said upper housing and said lower housing selectively in said closed condition in a snap action, and in said opened condition securely by spring force of said compression hinge units.

9. A security protected container and billfold according to claim 8 wherein each one of said compression hinge units comprises a closed end casing having two opposite flat side walls, a mounting pin extending through the central axis of said casing, a coil spring mounted on said mounting pin within said casing, an end slider rotatably mounted on said mounting pin and located inside said casing, said end slider having a body with two flat side walls, and said flat side walls of said end slider being slidably engaged with said two opposite flat side walls of said closed end axial openings of said central hinge portion, and said end slider being slidable in an axial direction of said casing to compress said coil spring, a U-shaped cam having two opposite cam arms formed on an outer surface of said end slider, a guiding cam mounted on an outer end of said mounting pin, said guiding cam having a U-shaped cam with two opposite cam arms similar to said U-shaped cam formed on the outer surface of said end slider, said guiding cam being fixedly mounted to an inner end of said hinge pin fixedly mounted in said upstanding hinge sleeve of said lower housing.

10. A security protected container and billfold according to claim 9 wherein said money clip is a spring plate mounted to extending arms of two Q-shaped rings, and said Q-shaped rings being slidably mounted to said hinge pins, said money clip pivotally resting on said lower housing when said billfold is in a closed condition, a lower end edge of said central hinge sleeve portion abutting a lower underside rear edge of said money clip whereby said money clip is pivoted by said lower end edge of said central hinge to a tilted upward position when said upper housing is pivoted to said opened position for facilitating placement of money currency on said money clip and to remove money currency therefrom.

* * * * *